US007611229B2

(12) United States Patent
Hibi et al.

(10) Patent No.: US 7,611,229 B2
(45) Date of Patent: Nov. 3, 2009

(54) INKJET HEAD

(75) Inventors: Manabu Hibi, Nagoya (JP); Kenichi Satake, Osaka (JP); Shin Ishikura, Krishima (JP)

(73) Assignees: Brother Kogyo Kabushiki Kaisha, Nagoya-shi, Aichi-ken (JP); Kyocera Corporation, Kyoto-shi, Kyoto-fu (JP)

( * ) Notice: Subject to any disclaimer, the term of this patent is extended or adjusted under 35 U.S.C. 154(b) by 395 days.

(21) Appl. No.: 11/693,977

(22) Filed: Mar. 30, 2007

(65) Prior Publication Data

US 2007/0211114 A1 Sep. 13, 2007

(30) Foreign Application Priority Data

Mar. 30, 2006 (JP) ..... 2006-095661

(51) Int. Cl.
*B41J 2/045* (2006.01)

(52) U.S. Cl. ..... 347/68; 347/70; 347/65

(58) Field of Classification Search ..... 347/20, 347/56, 61–65, 67, 68, 70–72
See application file for complete search history.

(56) References Cited

U.S. PATENT DOCUMENTS 5,495,270 A * 2/1996 Burr et al. ..... 347/68
6,808,254 B2 10/2004 Sakaida et al.
2005/0206681 A1 9/2005 Takahashi
2006/0050111 A1 3/2006 Mataki

FOREIGN PATENT DOCUMENTS

EP 1518679 A2 9/2004
JP 2003305852 A 10/2003

OTHER PUBLICATIONS

European Patent Office, European Search Report for Related EP Application No. 07251444 dated Jul. 27, 2007.

* cited by examiner

*Primary Examiner*—Juanita D Stephens
(74) *Attorney, Agent, or Firm*—Baker Botts, LLP

(57) ABSTRACT

An inkjet head includes a passage unit and an actuator unit. The passage unit includes a common ink chamber and an individual ink passage leading from an outlet of the common ink chamber through a pressure chamber to an ejection port. The actuator unit can selectively take a first state in which the volume of the pressure chamber is V1 and a second state in which the volume of the pressure chamber is V2 larger than V1. The actuator unit changes from the first state into the second state and then returns to the first state to eject ink from the ejection port. The individual ink passage is formed such that the volume Vd of a partial passage in the individual ink passage corresponding to a region from an outlet of the pressure chamber to the ejection port, and the volume Vc of the individual ink passage, satisfy a condition that Vd/Vc is not less than 0.12 and not more than 0.40.

4 Claims, 14 Drawing Sheets

INKJET HEAD

BACKGROUND OF THE INVENTION

1. Field of the Invention

The present invention relates to an inkjet head that ejects ink from ejection ports.

2. Description of Related Art

An inkjet head that ejects ink by an inkjet system includes nozzles for ejecting ink, a common ink chamber for supplying ink to be ejected from the nozzles, and individual ink passages leading from outlets of the common ink chamber to the ejection ports of the respective nozzles. In the inkjet head, part of each individual ink passage is formed into a pressure chamber. An actuator is provided for each pressure chamber to change the volume of the pressure chamber. An ejection pulse as a voltage signal is given to the actuator to deform the actuator. Due to the deformation of the actuator, pressure is applied to ink in the pressure chamber. As a result, ink is ejected from the corresponding nozzle. At this time, the pressure applied to ink in the pressure chamber induces a pressure wave, the medium for which is ink, in the individual ink passage. Japanese Patent Unexamined Publication No. 2003-305852 discloses an inkjet head that efficiently ejects ink by using proper oscillation in the individual ink passage due to the pressure wave. The inkjet head of the publication adopts a so-called fill-before-fire method, in which the volume of each pressure chamber is once increased and then the pressure chamber is restored to its original volume at a timing when the pressure in the pressure chamber becomes high because of the proper oscillation in the corresponding individual ink passage, to apply large ejection pressure to ink.

SUMMARY OF THE INVENTION

In the inkjet head that adopts the fill-before-fire method, as disclosed in the above publication, the ink ejection speed theoretically becomes the maximum when the width of the ejection pulse is ½ the period of the ink proper oscillation in the individual ink passage. The ink ejection speed gently decreases as the width of the ejection pulse gets away from ½ the period of the ink proper oscillation. Therefore, when a graph is drawn by using the width of the ejection pulse as the axis of abscissas and the ink ejection speed as the axis of ordinate, the curved line representing the ink ejection speed forms a monotonous curve that has a peak at a value of the ink ejection speed near ½ the period of the proper oscillation and monotonously decreases on both sides of the peak.

However, it was found in experiments by the inventors of the present invention that there are inkjet heads in which the curved line representing the ink ejection speed forms not a monotonous curve but an irregular curve having some maximal values near each of which the ink ejection speed sharply changes. In such an inkjet head, because the ink ejection speed sharply changes near each maximal value, a little change in the width of the ejection pulse may bring about a large change in the ink ejection speed. This adversely affects the quality of an image to be formed.

On the other hand, in an inkjet head, there is a case wherein two or more ink droplets are successively ejected from a nozzle in accordance with one ejection pulse. In general, the two or more ink droplets have substantially the same speed and substantially the same volume. However, it was also found in experiments by the inventors of the present invention that the ink droplet ejected first is higher in speed and extremely smaller in volume than the second or later ink droplets in the case of the above-described inkjet head in which the ink ejection speed sharply changes near each maximal value. Because the high-speed small ink droplet impacts a printing paper at an earlier timing than the normal ink droplets, this degrades the quality of an image to be formed on the printing paper by the inkjet head.

An object of the present invention is to provide an inkjet head capable of printing with good image quality because the ink ejection speed does not sharply change near any maximal value and the difference in speed and volume is little between the first ink droplet and the second or later ink droplets to be ejected in accordance with one ejection pulse.

The inventors of the present invention carried out the following two simulations using a numeric analysis model, on the basis of a supposition that the cause of a sharp change in ink ejection speed near a maximal value and making the first ejected ink droplet have a higher speed and an extremely smaller volume than the second or later ejected ink droplets in accordance with the same ejection pulse, may relate to the ratio between the volume Vd of a partial passage in each individual ink passage, which is called a descender corresponding to a region of the individual ink passage from an outlet of the pressure chamber to the ejection port, and the volume Vc of the individual-ink passage.

First, to several values of Vd/Vc, the inventors obtained changes in ink ejection speed relative to a change in (the width Tl of the ejection pulse)/(the ink proper oscillation period Tc in the individual ink passage). Secondly, with fixing the value of Tl/Tc, the inventors obtained changes in the ratios of speed and volume between the first and second ink droplets ejected from a nozzle in accordance with one ejection pulse, to a change in Vd/Vc. Consequently, the inventors found that a condition that Vd/Vc is not less than 0.12 and not more than 0.40 should be satisfied for avoiding a sharp change in ink ejection speed near any maximal value on a curved line that represents a change in ink ejection speed relative to a change in Tl/Tc; and for preventing the first and second ink droplets in accordance with one ejection pulse from remarkably differing from each other in speed and volume. The inventors further found that better results are obtained in a range that Vd/Vc is not less than 0.15 and not more than 0.40.

According to the above inventors' analysis, an inkjet head of the present invention comprises a passage unit comprising a common ink chamber and an individual ink passage leading from an outlet of the common ink chamber through a pressure chamber to an ejection port; and an actuator that can selectively take a first state in which the volume of the pressure chamber is V1 and a second state in which the volume of the pressure chamber is V2 larger than V1. The actuator changes from the first state into the second state and then returns to the first state to eject ink from the ejection port. The individual ink passage is formed such that the volume Vd of a partial passage in the individual ink passage corresponding to a region from an outlet of the pressure chamber to the ejection port, and the volume Vc of the individual ink passage, satisfy a condition that Vd/Vc is not less than 0.12 and not more than 0.40. The individual ink passage is preferably formed so as to satisfy a condition that Vd/Vc is not less than 0.15 and not more than 0.40.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

General Construction of Printer

Figure 1:
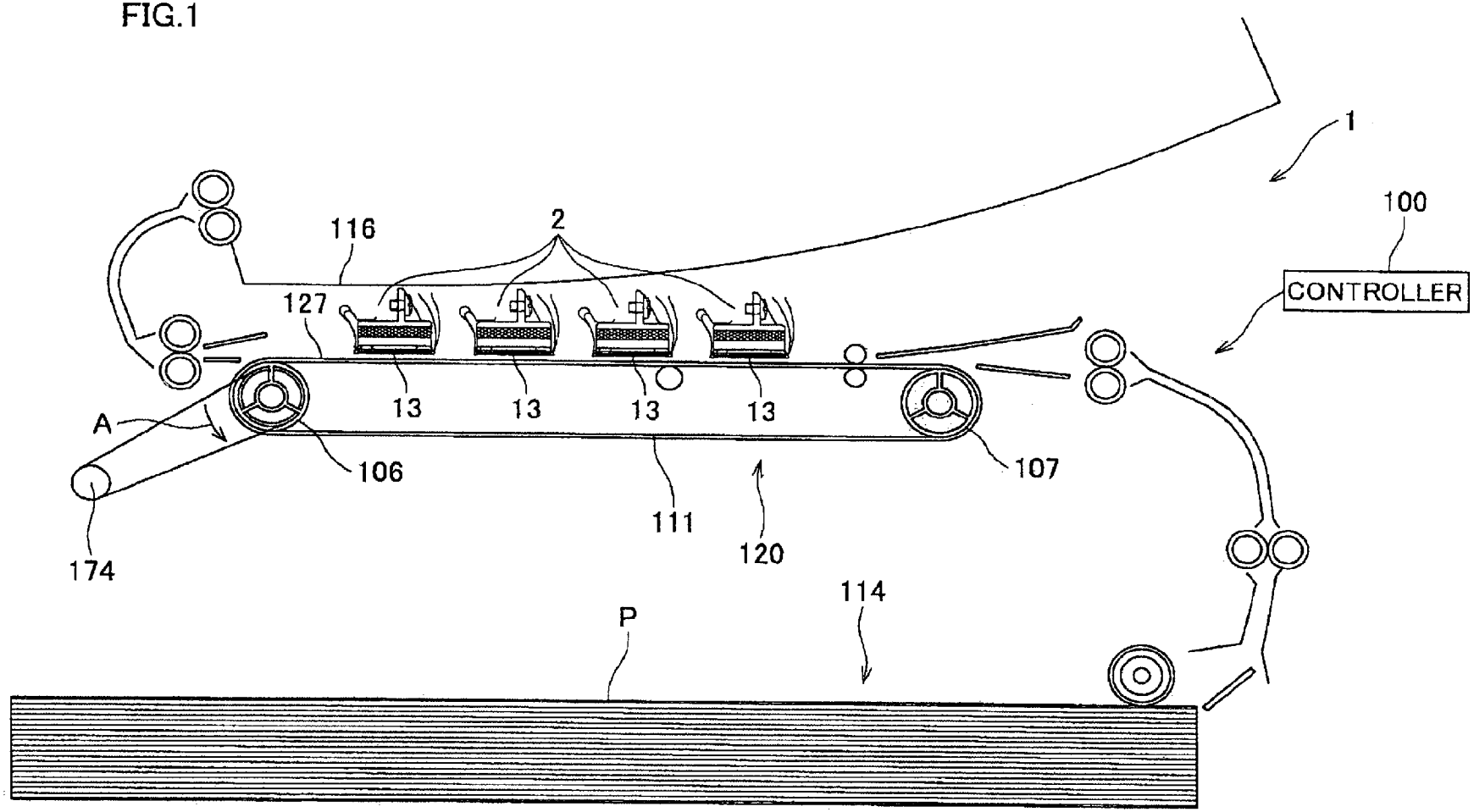
FIG. 1 shows a general construction of a printer including therein inkjet heads according to an embodiment of the present invention.

FIG. 1 shows a general construction of a color inkjet printer including inkjet heads according to an embodiment of the present invention. The printer 1 includes therein four inkjet heads 2. The inkjet heads 2 are fixed to the printer 1 in a state of being arranged in the direction of conveyance of printing papers P. Each inkjet head 2 has a slender profile extending perpendicularly to FIG. 1.

The printer 1 includes therein a paper feed unit 114, a conveyance unit 120, and a paper receiving unit 116 provided in this order along the conveyance path for printing papers P. The printer 1 further includes therein a controller 100 that controls the operations of components and units of the printer 1, such as the inkjet heads 2 and the paper feed unit 114.

The conveyance unit 120 includes an endless conveyor belt 111 and two belt rollers 106 and 107. The conveyor belt 111 is wrapped on the belt rollers 106 and 107. The length of the conveyor belt 111 is adjusted so that a predetermined tension can be obtained when the conveyor belt 111 is stretched between the belt rollers. Thus, the conveyor belt 111 is stretched between the belt rollers without slacking, along two planes parallel to each other, each including a common tangent of the belt rollers. Of these two planes, the plane nearer to the inkjet heads 2 includes a conveyance surface 127 of the conveyor belt 111 on which printing papers P are conveyed.

As shown in FIG. 1, one belt roller 106 is connected to a conveyance motor 174. The conveyance motor 174 can rotate the belt roller 106 in the direction of an arrow A. The other belt roller 107 can follow the conveyor belt 111 to rotate. Thus, by driving the conveyance motor 174 to rotate the belt roller 106, the conveyor belt 111 is moved in the direction of the arrow A. Each printing paper P sent from the paper feed unit 114 to the conveyance unit 120 is conveyed toward the inkjet heads 2 by the rotation of the conveyor belt 111.

Figure 3:
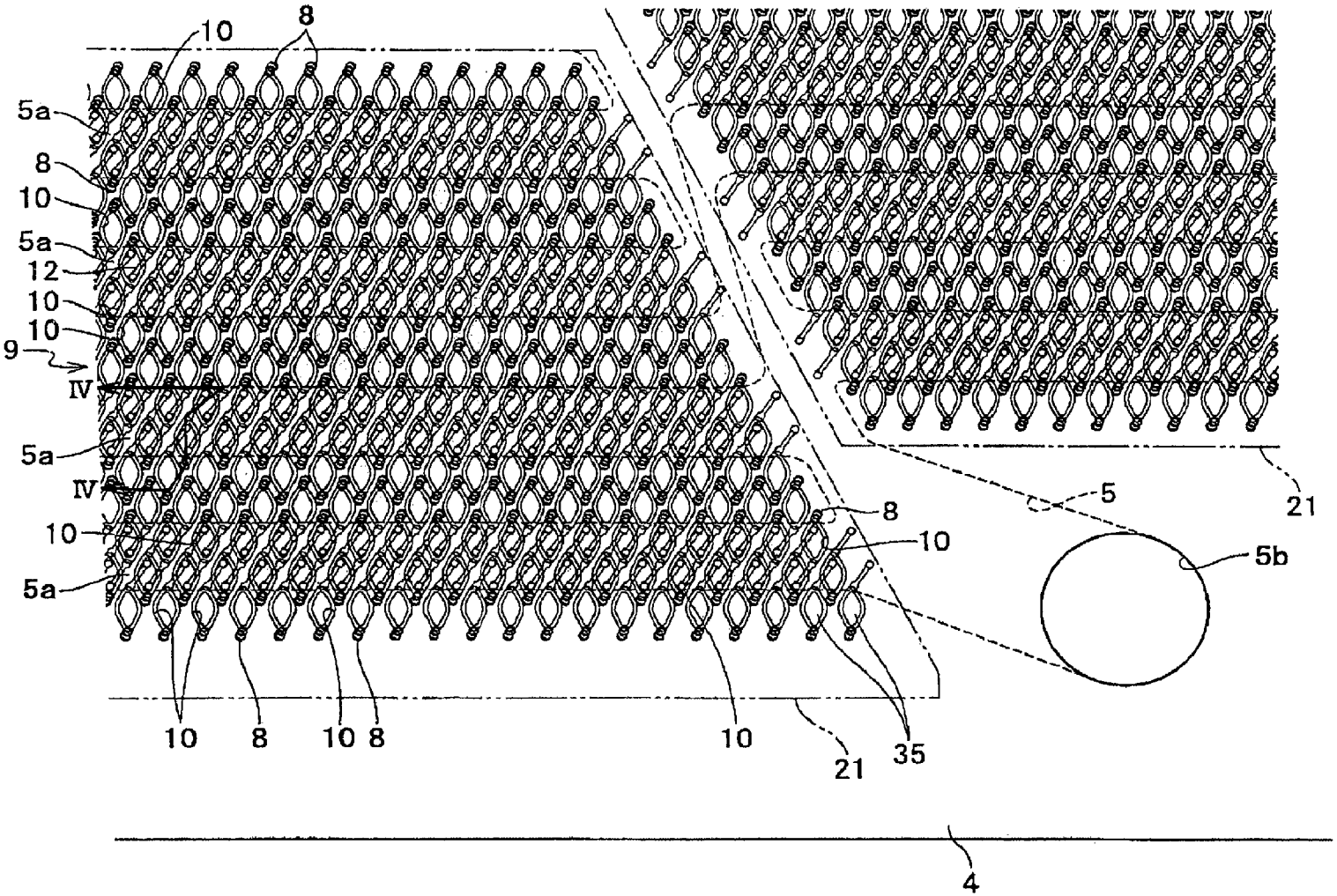
FIG. 3 is an enlarged view of a region enclosed with an alternate long and short dash line in FIG. 2.

Four inkjet heads 2 are arranged close to each other in the direction of conveyance by the conveyor belt 111. Each inkjet head 2 has at its lower end a head main body 13. A large number of ejection ports 8 from each of which ink is ejected are formed on the lower face of each head main body 13, as shown in FIG. 3. Ink of the same color is ejected from the ejection ports 8 formed on one inkjet head 2. Four inkjet heads 2 eject inks of colors of magenta (M), yellow (Y), cyan (C), and black (K), respectively. Each inkjet head 2 is disposed such that a narrow space is formed between the lower face of the head main body 13 and the conveyance surface 127 of the conveyor belt 111.

Each printing paper P being conveyed by the conveyor belt 111 passes through the space between each inkjet head 2 and the conveyor belt 111. At this time, ink is ejected from the head main body 13 of the inkjet head 2 toward the upper surface of the printing paper P. Thus, a color image based on image data stored in the controller 100 is formed on the upper surface of the printing paper P. The printing paper P on which the color image has been printed is sent to the paper receiving unit 116.

<Head Main Body>

Figure 2:
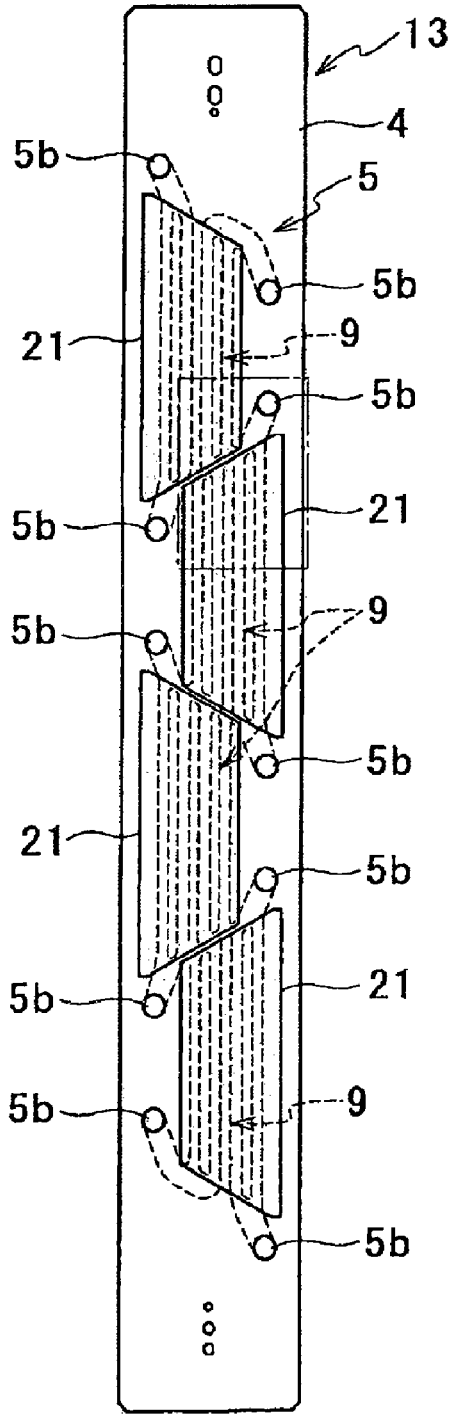
FIG. 2 is an upper view of a head main body shown in FIG. 1.

The head main body 13 of each inkjet head 2 will be described. FIG. 2 is an upper view of a head main body 13 shown in FIG. 1.

The head main body 13 includes a passage unit 4 and four actuator units 21 each bonded onto the passage unit 4. Each actuator unit 21 is substantially trapezoidal. Each actuator unit 21 is disposed on the upper surface of the passage unit 4 such that a pair of parallel-opposed sides of the trapezoid of the actuator unit 21 extend longitudinally of the passage unit 4. Two actuator units 21 are arranged on each of two imaginary straight lines extending parallel to each other longitudinally of the passage unit 4. That is, four actuator units 21 in total are arranged zigzag on the passage unit 4 as a whole. Each neighboring oblique sides of actuator units 21 on the passage unit 4 partially overlap each other laterally of the passage unit 4.

Manifold channels 5 each of which is part of an ink passage are formed in the passage unit 4. An opening 5*b* of each manifold channel 5 is formed on the upper face of the passage unit 4. Five openings 5*b* are arranged on each of two imaginary straight lines extending parallel to each other longitudinally of the passage unit 4. That is, ten openings 5*b* in total are formed. The openings 5*b* are formed so as to avoid the regions where four actuator units 21 are disposed. Ink is supplied from a not-shown ink tank into each manifold channel 5 through its opening 5*b*.

FIG. 3 is an enlarged upper view of a region enclosed with an alternate long and short dash line in FIG. 2. In FIG. 3, for convenience of explanation, each actuator unit 21 is shown by an alternate long and two short dashes line. In addition, apertures 12, ejection ports 8, and so on, are shown by solid lines though they should be shown by broken lines because they are formed in the passage unit 4 or on the lower face of the passage unit 4.

Each manifold channel 5 formed in the passage unit 4 branches into a number of sub manifold channels 5*a* as common ink chambers. The sub manifold channels 5*a* extend longitudinally of the head main body 13 in the passage unit 4 so as to neighbor each other in a region opposed to each actuator unit 21.

The passage unit 4 includes therein pressure chamber groups 9 each constituted by a number of pressure chambers 10 arranged in a matrix. Each pressure chamber 10 is formed into a hollow region having a substantially rhombic shape in plan view each corner of which is rounded. Each pressure chamber 10 is defined by the corresponding actuator unit 21 covering a recess formed on the upper face of the passage unit 4. A number of pressure chambers 10 are arranged substantially over a region of the upper face of the passage unit 4 opposed to each actuator unit 21. Thus, each pressure chamber group 9 constituted by the pressure chambers 10 occupies a region having substantially the same size and shape as one actuator unit 21.

In this embodiment, as shown in FIG. 3, there are formed sixteen rows of pressure chambers 10 being longitudinal of the passage unit 4. The pressure chambers 10 are disposed such that the number of pressure chambers 10 belonging to each row gradually decreases from the long side toward the short side of the profile of the corresponding piezoelectric actuator 50. The ejection ports 8 are disposed likewise. This realizes image formation with a resolution of 600 dpi as a whole.

An individual electrode 35, as will be described later, is formed on the upper face of each actuator unit 21 so as to be opposed to each pressure chamber 10. The individual electrode 35 has its shape somewhat smaller than and substantially similar to the shape of the pressure chamber 10. In a plan view, a major part of the individual electrode 35 is within the corresponding pressure chamber 10.

A large number of ejection ports 8 are formed on the lower face of the passage unit 4. The ejection ports 8 are disposed within regions opposed to the respective actuator units 21. The ejection ports 8 are disposed in regions of the lower face of the passage unit 4 not opposed to sub manifold channels 5*a*. A number of ejection ports 8 in each region are on one of sixteen straight lines each extending longitudinally of the passage unit 4. The ejection ports 8 on each straight line are arranged at regular intervals. When all ejection ports 8 formed on the passage unit 4 are projected on an imaginary straight line extending longitudinally of the passage unit 4, perpendicularly to the straight line, the obtained projective points are arranged on the imaginary straight line at regular intervals corresponding to the printing resolution.

A large number of apertures 12, each of which functions as a throttle, are formed in the passage unit 4. The apertures 12 are disposed in regions opposed to the respective pressure chamber groups 9. The aperture 12 extend horizontally parallel to each other.

Figure 4:
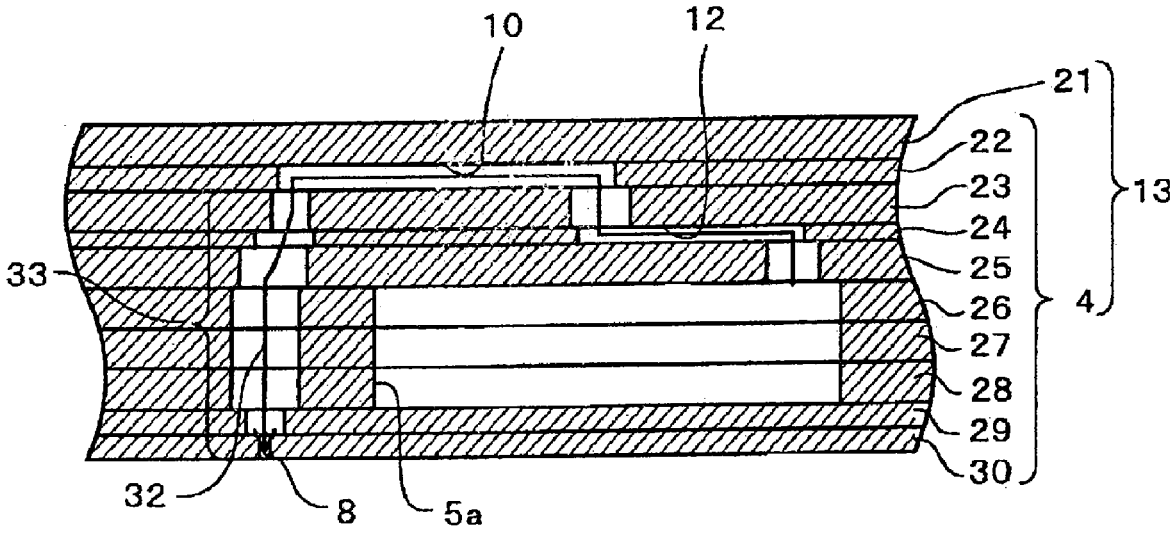
FIG. 4 is a vertically sectional view taken along line IV-IV in FIG. 3.

In the passage unit 4, connection holes are formed so as to connect each corresponding aperture 12, pressure chamber 10, and ejection port 8 with each other. The connection holes are connected with each other to form an individual ink passage 32, as shown in FIG. 4. Each individual ink passage 32 is connected at its one end with the corresponding sub manifold channel 5*a*. Ink supplied to each manifold channel 5 is supplied to each individual ink passage 32 via the corresponding sub manifold channel 5*a* and then ejected from the corresponding ejection port 8.

<Individual Ink Passage>

A sectional construction of the head main body 13 will be described. FIG. 4 is a vertically sectional view taken along line IV-IV in FIG. 3.

The passage unit 4 of the head main body 13 has a layered structure in which nine plates are put in layers. That is, in the order from the upper face of the passage unit 4, there are disposed a cavity plate 22, a base plate 23, an aperture plate 24, a supply plate 25, three manifold plates 26, 27, and 28, a cover plate 29, and a nozzle plate 30. A large number of connection holes are formed in the plates 22 to 29. The plates are put in layers after they are positioned so that connection holes formed through the respective plates are connected with each other to form each individual ink passage 32 and each sub manifold channel 5*a*.

Connection holes formed through the respective plates will be described. The first is a pressure chamber 10 formed through the cavity-plate 22. The second is a connection hole A that forms a passage leading from one end of the pressure chamber 10 to a sub manifold channel 5*a*. The connection hole A is formed through the plates from the base plate 23, more specifically, the inlet of the pressure chamber 10, to the supply plate 25, more specifically, the outlet of the sub manifold channel 5*a*. The connection hole A includes an aperture 12 formed through the aperture plate 24.

The third is a connection hole B that forms a passage leading from the other end of the pressure chamber 10 to an ejection port 8. The connection hole B is formed through the plates from the base plate 23, more specifically, the outlet of the pressure chamber 10, to the nozzle plate 29, more specifically, the ejection port 8. In the below, the connection hole B will be referred to as descender 33, which is a partial passage. The fourth is a connection hole C that forms the sub manifold channel 5*a*. The connection hole C is formed through the manifold plates 26 to 28.

The above connection holes are connected with each other to form an individual ink passage 32 leading from an ink inlet port from the sub manifold channel 5*a*, that is, an outlet of the sub manifold channel 5*a*, to the ejection port 8. Ink supplied to the sub manifold channel 5*a* flows to the ejection port 8 in the following passage. First, ink flows upward from the sub manifold channel 5*a* to one end of the aperture 12. Next, ink horizontally flows longitudinally of the aperture 12 to the other end of the aperture 12. Ink then flows upward from the other end of the aperture 12 to one end of the pressure chamber 10. Ink then horizontally flows longitudinally of the pressure chamber 10 to the other end of the pressure chamber 10. Ink then flows obliquely downward through three plates and then flows in the descender 33 to the nozzle 8 just below the descender 33.

<Actuator Unit>

Figure 5:
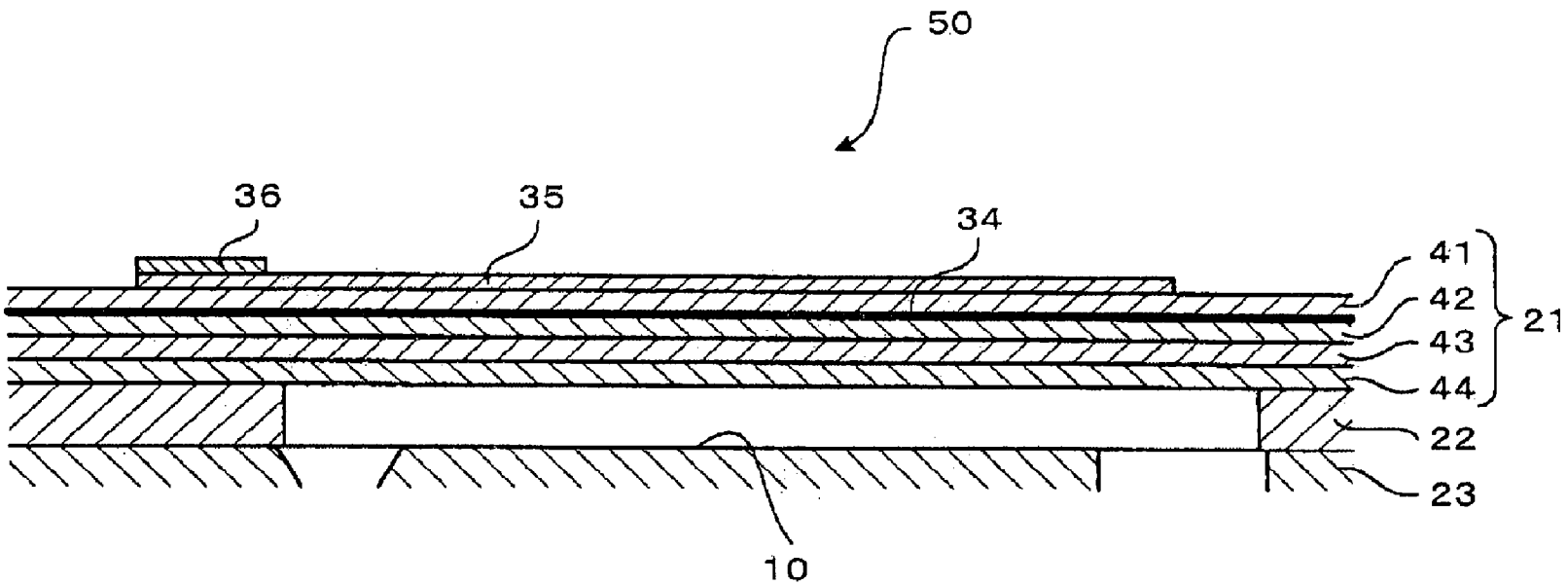
FIG. 5 is a partial enlarged view near a piezoelectric actuator shown in FIG. 4.

As shown in FIG. 5, each actuator unit 21 has a layered structure in which four piezoelectric layers 41, 42, 43, and 44 are put in layers. Each of the piezoelectric layers 41 to 44 has a thickness of about 15 micrometers. The whole thickness of the actuator unit 21 is about 60 micrometers. Any of the piezoelectric layers 41 to 44 is disposed over a number of pressure chambers 10, as shown in FIG. 3. Each of the piezoelectric layers 41 to 44 is made of a lead zirconate titanate (PZT)-base ceramic material having ferroelectricity.

The actuator unit 21 includes individual electrodes 35 and a common electrode 34, each of which is made of, for example, an Ag—Pd-base metallic material. As described before, each individual electrode 35 is disposed on the upper face of the actuator unit 21 so as to be opposed to the corresponding pressure chamber 10. One end of the individual electrode 35 is extended out of the region opposed to the pressure chamber 10, and a land 36 is formed on the extension. The land 36 is made of, for example, gold containing glass frit. The land 36 has a thickness of about 15 micrometers and is convexly formed. The land 36 is electrically connected to a contact provided on a not-shown flexible printed circuit (FPC). As will be described later, the controller 100 supplies a voltage pulse to each individual electrode 35 via the FPC.

The common electrode 34 is interposed between the piezoelectric layers 41 and 42 so as to spread over substantially the whole area of the interface between the layers. That is, the common electrode 34 spreads over all pressure chambers 10 in the region opposed to the actuator unit 21. The common electrode 34 has a thickness of about 2 micrometers. The common electrode 34 is grounded in a not-shown region to be kept at the ground potential. In this embodiment, a not-shown surface electrode different from the individual electrodes 35 is formed on the piezoelectric layer 41 so as to avoid the group of the individual electrodes 35. The surface electrode is electrically connected to the common electrode 34 through a through hole formed in the piezoelectric layer 41. Like a large number of individual electrodes 35, the surface electrode is connected to another contact and wiring on the FPC 50.

As shown in FIG. 5, each individual electrode 35 and the common electrode 34 are disposed so as to sandwich only the uppermost piezoelectric layer 41. The region of the piezoelectric layer sandwiched by the individual electrode 35 and the common electrode 34 is called an active portion. Only the uppermost piezoelectric layer 41 includes therein such active portions and the remaining piezoelectric layers 42 to 44 includes therein no active portions. That is, the actuator unit 21 is a so-called unimorph type.

As will be described later, when a predetermined voltage pulse is selectively supplied to each individual electrode 35, pressure is applied to ink in the pressure chamber 10 corresponding to the individual electrode 35. Thereby, ink is ejected from the corresponding ejection port 8 through the corresponding individual ink passage 32. That is, a portion of the actuator unit 21 opposed to each pressure chamber 10 serves as an individual piezoelectric actuator 50 corresponding to the pressure chamber 10 and the corresponding ejection port 8. In the layered structure constituted by four piezoelectric layers, such an actuator as a unit structure as shown in FIG. 5 is formed for each pressure chamber 10. Each actuator unit 21 is thus constructed. In this embodiment, the amount of ink to be ejected from an ejection port 8 in one ejection operation is about 5 to 7 pl (picoliters).

<Designing of Descender and Individual Ink Passage>

In this embodiment, the volume Vd of a descender 33 and the volume Vc of an individual ink passage 32 satisfy a condition that Vd/Vc is not less than 0.15 and not more than 0.40. More specifically, the volume Vd of the descender 33 is 0.24 times the volume Vc of the individual ink passage 32, that is, Vd/Vc=0.24. Because each inkjet head 2 is thus designed, no sharp change in ink ejection speed exists near any maximal value on a curved line that represents a change in ink ejection speed relative to a change in Tl/Tc. In addition, the first and second ink droplets in accordance with one ejection pulse do not extremely differ from each other in speed and volume.

In addition, the value of square-root (Sd/π)/Ld, obtained by dividing, by the length of the descender 33, the square root of the value obtained by dividing the mean sectional area of the descender 33 by the circle ratio, satisfies a condition that square-root (Sd/π)/Ld is not less than 0.1 and not more than 0.3. More specifically, the value of square-root (Sd/π)/Ld is 0.2. Because each inkjet head 2 is thus designed, this makes it easy to attenuate the pressure fluctuation with a period shorter than Tc in the individual ink passage 32 with suppressing variation in ink ejection speed from nozzle to nozzle due to variation in descender diameter.

<Control of Actuator Unit>

Figure 6:
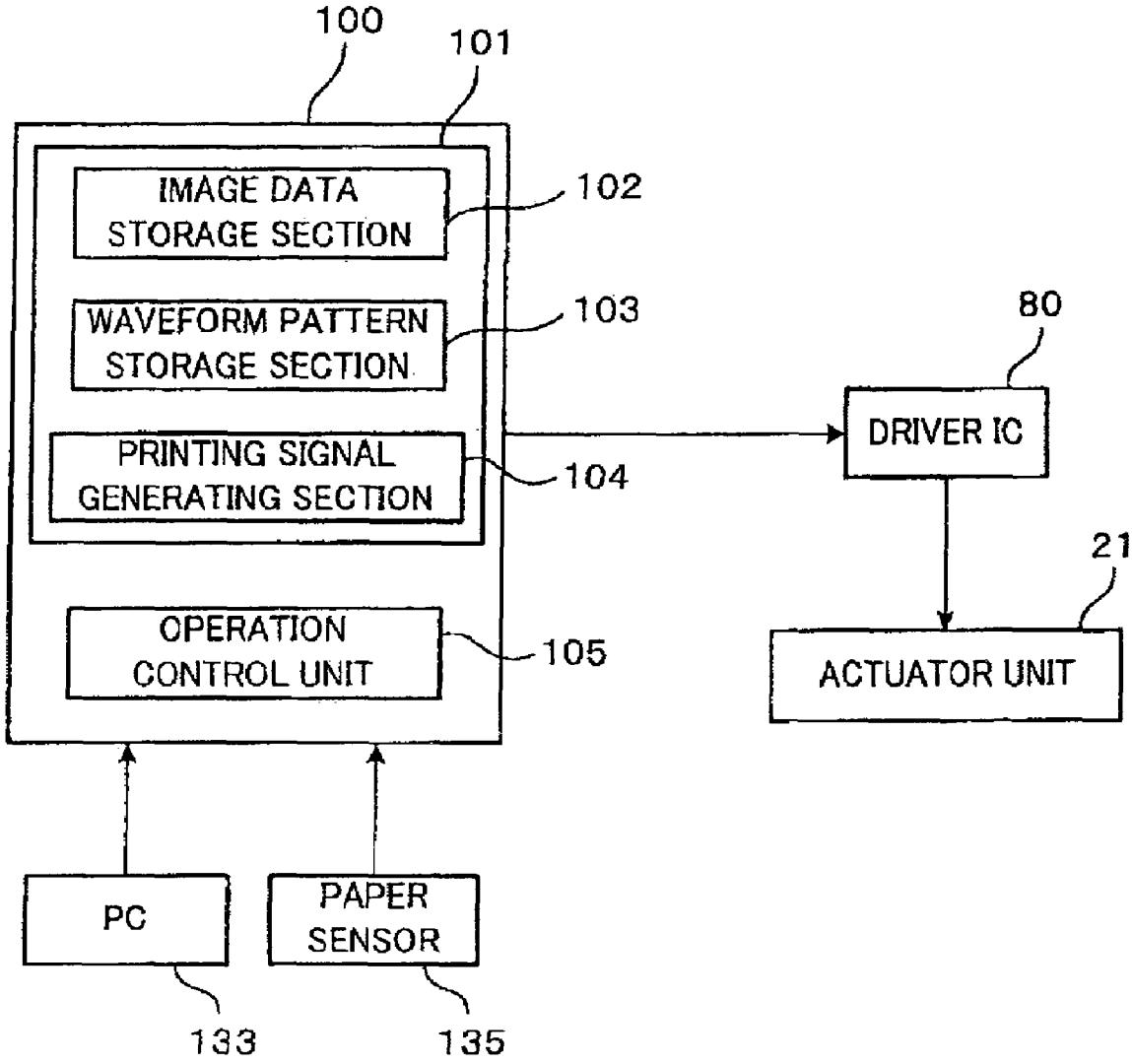
FIG. 6 is a block diagram showing a construction of a controller included in the printer shown in FIG. 1.

Next, control of the actuator units 21 will be described. For controlling the actuator units 21, the printer 1 includes therein a controller 100 and driver ICs 80 as shown in FIG. 6. The printer 1 includes therein a central processing unit (CPU) as an arithmetic processing unit; a read only memory (ROM) storing therein computer programs to be executed by the CPU and data used in the programs; and a random access memory (RAM) for temporarily storing data in execution of a computer program. These and other hardware components constitute the controller 100 having functions as will be described below.

As shown in FIG. 6, the controller 100 includes therein a printing control unit 101 and an operation control unit 105. The printing control unit 101 includes therein an image data storage section 102, a waveform pattern storage section 103, and a printing signal generating section 104. The image data storage section 102 stores therein image data for printing, transmitted from, for example, a personal computer (PC) 133.

The waveform pattern storage section 103 stores therein waveform data corresponding to a number of ejection pulse train waveforms. Each ejection pulse train waveform corresponds to a basic waveform in accordance with the tone and so on of an image. A voltage pulse signal corresponding to the waveform is supplied to individual electrodes 35 via the corresponding driver IC 80 and thereby an amount of ink corresponding to each tone is ejected from each inkjet head 2.

The printing signal generating section 104 generates serial printing data on the basis of image data stored in the image data storage section 102. The printing data is for supplying one of the ejection pulse train waveforms stored in the waveform pattern storage section 103, to individual electrodes 35 in order. The printing data is data for instruction for supplying the ejection pulse train waveform to each individual electrode 35 at a predetermined timing. On the basis of image data stored in the image data storage section 102, the printing signal generating section 104 generates printing data in accordance with timings, a waveform, and individual electrodes, corresponding to the image data. The printing signal generating section 104 then outputs the generated printing data to each driver IC 80.

A driver IC 80 is provided for each actuator unit 21. The driver IC 80 includes a shift register, a multiplexer, and a drive buffer, though any of them is not shown.

The shift register converts the serial printing data output from the printing signal generating section 104, into parallel data. That is, following the instruction of the printing data, the shift register outputs an individual data item to the piezoelectric actuator 50 corresponding to each pressure chamber 10 and the corresponding ejection port 8.

On the basis of each data item output from the shift register, the multiplexer selects appropriate one out of the ejection pulse train waveforms according to the waveform data supplied from the waveform pattern storage section 103 to the driver IC 80. The multiplexer then outputs the selected ejection pulse train waveform to the drive buffer.

The drive buffer amplifies the ejection pulse train waveform output from the multiplexer, to generate an ejection voltage pulse train signal having a predetermined level. The drive buffer then supplies the ejection voltage pulse train signal to the individual electrode 35 corresponding to each piezoelectric actuator 50, through the FPC.

<Change in Potential in Ink Ejection>

Next will be described an ejection voltage pulse train signal and a change in the potential of an individual electrode 35 having received the signal.

Figure 7:
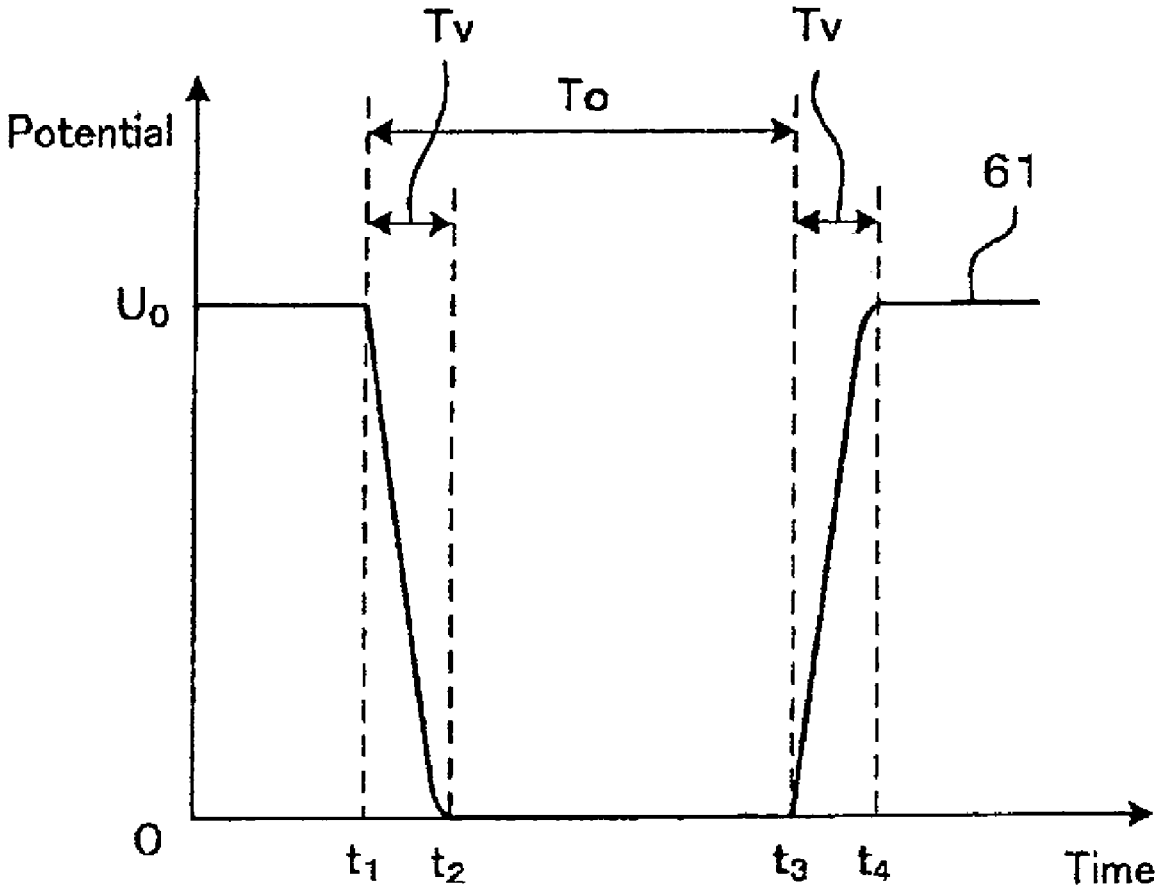
FIG. 7 is a graph showing the waveform of a voltage pulse to be supplied to an individual electrode shown in FIG. 5 for ink ejection.

The voltage at each time contained in the ejection voltage pulse train signal will be described. FIG. 7 shows an example of a change in the potential of an individual electrode 35 to which the ejection voltage pulse train signal is supplied. The waveform 61 of the ejection voltage pulse train signal shown in FIG. 7 is an example of a waveform for ejecting one droplet of ink from an ejection port 8.

At a time t1, the ejection voltage pulse train signal starts to be supplied to the individual electrode 35. The time t1 is controlled in accordance with a timing at which ink is ejected from the ejection port 8 corresponding to the individual electrode 35. In the waveform 61 of the ejection voltage pulse train signal, the voltage is kept at U0, which is larger then zero, in the period to the time t1 and in the period after a time t4. In the period from a time t2 to a time t3, the voltage is kept at the ground potential. The period from the time t1 to the time t2 is a transient period in which the potential of the individual electrode 35 changes from U0 to the ground potential. The period from the time t3 to the time t4 is a transient period in which the potential of the individual electrode 35 changes from the ground potential to U0. As shown in FIG. 5, each piezoelectric actuator 50 has the same construction as a capacitor. Thus, when the potential of the individual electrode 35 changes, the above transient periods appear in accordance with accumulation and emission of electric charges.

<Drive of Actuator in Ink Ejection>

Next will be described how the piezoelectric actuator 50 is driven when the above ejection voltage pulse train signal is supplied to the individual electrode 35.

In each actuator unit 21 of this embodiment, only the uppermost piezoelectric layer 41 has been polarized in the direction from each individual electrode 35 toward the common electrode 34. Thus, when an individual electrode 35 is set at a different potential from the common electrode 34 so as to apply an electric field to the piezoelectric layer 41 in the same direction as that of the polarization, more specifically, in the direction from the individual electrode 35 toward the common electrode 34, the portion to which the electric field has been applied, that is, the active portion, attempts to elongate in the thickness, that is, perpendicularly to the layer. At this time, the active portion attempts to contract parallel to the layer, that is, in the plane of the layer. On the other hand, the remaining three piezoelectric layers 42 to 44 have not been polarized, and they are not deformed by themselves even when an electric field is applied to them.

A difference in distortion is thus generated between the piezoelectric layer 41 and the piezoelectric layers 42 to 44. Therefore, each piezoelectric actuator 50 is deformed as a whole to be convex toward the corresponding pressure chamber 10, which is called unimorph deformation.

Figure 8A:
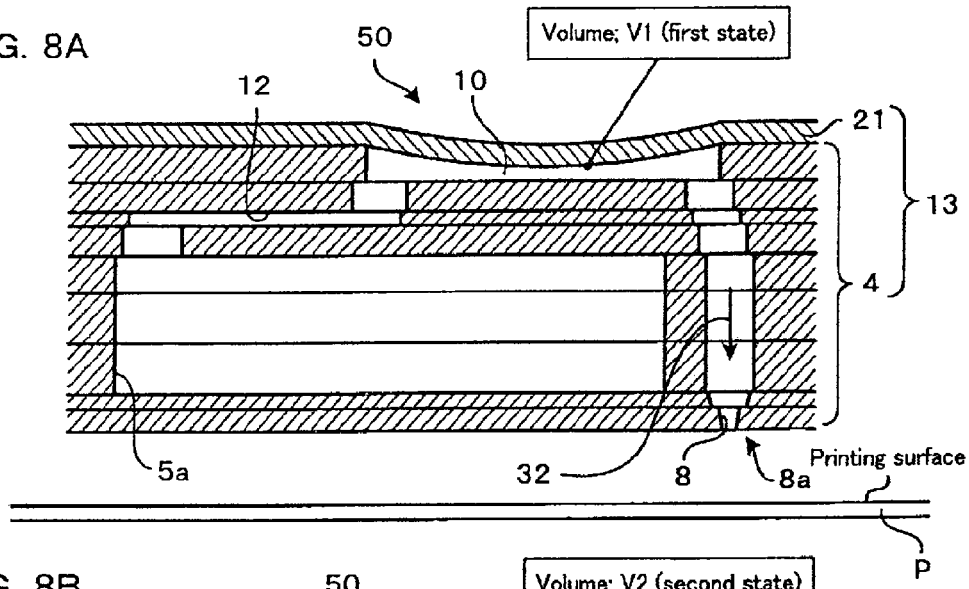
FIGS. 8A, 8B, and 8C show a driving manner of an actuator unit when the voltage pulse shown in FIG. 7 is supplied to the individual electrode.
Figure 8B:
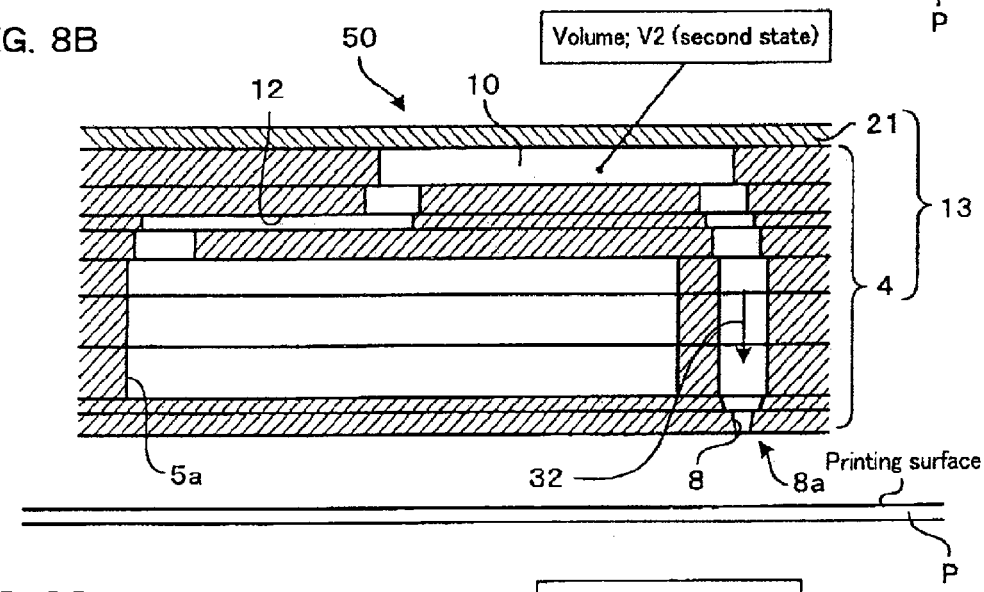
Figure 8C:
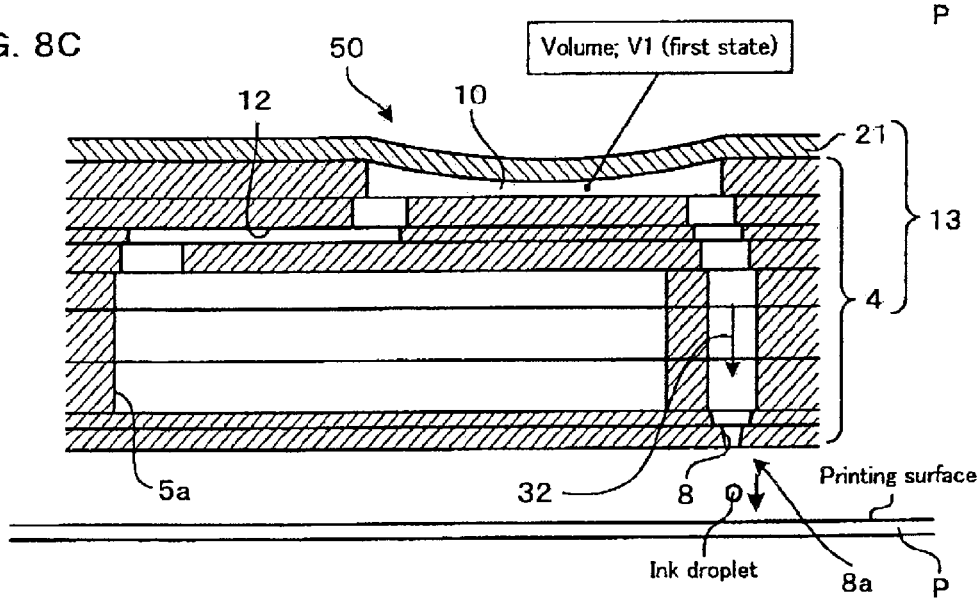

Next will be described drive of a piezoelectric actuator 50 when a voltage pulse signal corresponding to the waveform 61 is supplied to the corresponding individual electrode 35. FIGS. 8A to 8C show a change in the piezoelectric actuator 50 with time.

FIG. 8A shows the state of the piezoelectric actuator 50 in the period to the time t1 shown in FIG. 7. At this time, the potential of the individual electrode 35 is U0. The piezoelectric actuator 50 protrudes into the corresponding pressure chamber 10 by the above-described unimorph deformation. The volume of the pressure chamber 10 at this time is V1. This state of the pressure chamber 10 will be referred to as a first state.

FIG. 8B shows the state of the piezoelectric actuator 50 in the period from the time t2 to the time t3 shown in FIG. 7. At this time, the individual electrode 35 is at the ground potential. Therefore, the electric field disappears that was applied to the active portion of the piezoelectric layer 41, and the piezoelectric actuator 50 is released from its unimorph deformation. The volume V2 of the pressure chamber 10 at this time is larger than the volume V1 of the pressure chamber 10 shown in FIG. 8A. This state of the pressure chamber 10 will be referred to as a second state. As a result of an increase in the volume of the pressure chamber 10, ink is sucked into the pressure chamber 10 from the corresponding sub manifold channel 5*a*.

FIG. 8C shows the state of the piezoelectric actuator 50 in the period after the time t4 shown in FIG. 7. At this time, the potential of the individual electrode 35 is U0. Therefore, the piezoelectric actuator 50 has been again restored to the first state. By the piezoelectric actuator 50 thus changing the pressure chamber 10 from the second state into the first state, a pressure is applied to ink in the pressure chamber 10. Thereby, an ink droplet is ejected from the corresponding ejection port B. The ink droplet impacts the printing surface of a printing paper P to form a dot.

As described above, in the drive of the piezoelectric actuator 50 of this embodiment, first, the volume of the pressure chamber 10 is once increased to generate a negative pressure wave in ink in the pressure chamber 10, as shown from FIG. 8A to FIG. 8B. The pressure wave is reflected by the outlet of the sub manifold channel 5*a*, and thereby returned as a positive pressure wave progressing toward the ejection port 8. With estimating a timing at which the positive pressure wave reaches the interior of the pressure chamber 10, the volume of the pressure chamber 10 is again decreased, as shown from FIG. 8B to FIG. 8C. This is a so-called fill-before-fire method.

In order to realize ink ejection by the above-described fill-before-fire method, the pulse width To of the voltage pulse having the waveform 61 for ink ejection, as shown in FIG. 7, is adjusted to the acoustic length (AL). In this embodiment, each pressure chamber 10 is provided near the center of the whole length of the corresponding individual ink passage 32, and AL is the length of a time period for which a pressure wave generated in the pressure chamber 10 progresses from the outlet of the corresponding sub manifold channel 5*a* to the corresponding ejection port 8. In this construction, the positive pressure wave reflected as described above is superimposed on a positive pressure wave generated because of deformation of the corresponding piezoelectric actuator 50 so that a higher pressure is applied to ink. Therefore, in comparison with a case wherein the volume of the pressure chamber 10 is decreased only one time to push ink out, the driving voltage for the piezoelectric actuator 50 is held down when the same amount of ink is ejected. Thus, the fill-before-fire method is advantageous in high integration of pressure chambers 10, compactification of an inkjet head 2, and the running cost for driving the inkjet head 2.

<Numeric Analysis>

Figure 9A:
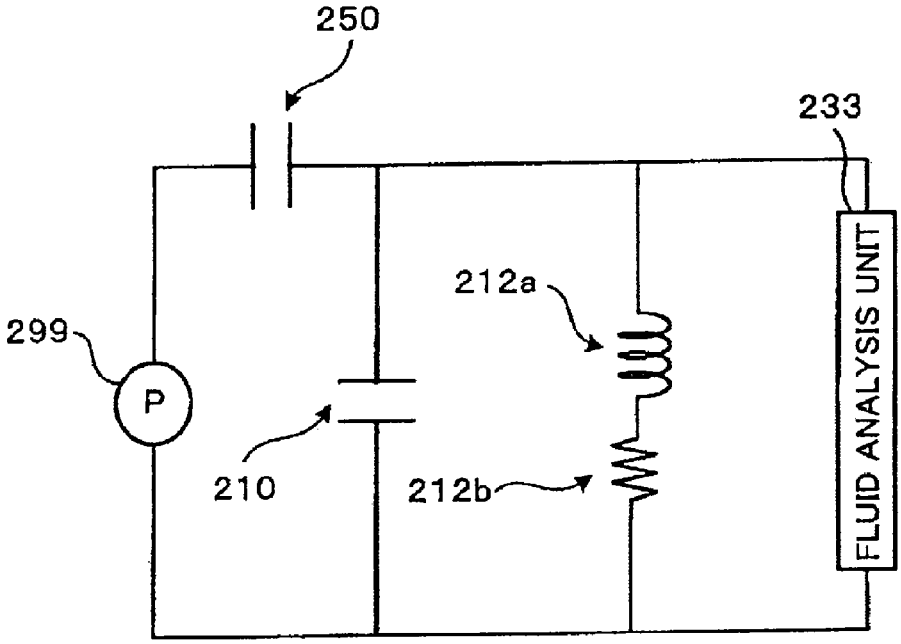
FIGS. 9A, 9B, and 9C are a circuit diagram and representations for explaining a numeric analysis model in the inkjet head.
Figure 9B:
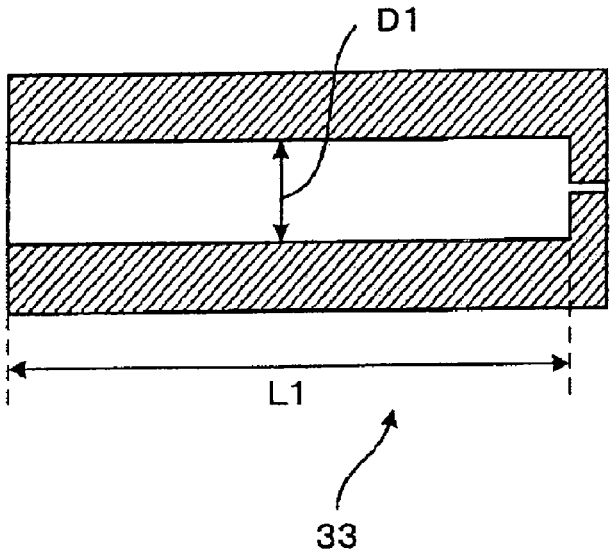
Figure 9C:
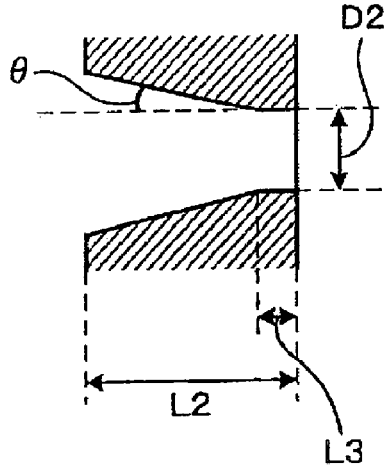

For fill-before-fire type inkjet heads as described above, the inventors of the present invention carried out the following numeric analysis. FIGS. 9A, 9B, and 9C are a circuit diagram and representations showing a model used in the numeric analysis.

In the numeric analysis, a circuit is constructed by acoustically equivalent conversion of an individual ink passage 32 as shown in FIG. 4, that is, a passage leading from an outlet of a sub manifold channel 5*a* to an ejection port 8. The equivalent circuit was acoustically analyzed. FIG. 9A shows the equivalent circuit.

The equivalent circuit shown in FIG. 9A corresponds to an ink passage and an actuator as shown in, for example, FIGS. 4, and 5. In the below description, therefore, the terms of the descender 33, the piezoelectric actuator 50, and so on, as shown in, for example, FIGS. 4 and 5, will be used. However, information on the actuator, for example, shown in FIG. 5, necessary for the numeric analysis, is compliance. Therefore, in any actuator having the same compliance to apply a pressure to ink in a pressure chamber, the same results of the numeric analysis are obtained. That is, the results obtained by the numeric analysis as will be described below can apply to not only the passage unit 4 and the piezoelectric actuator 50 shown in, for example, FIGS. 4 and 5, but also any inkjet head that satisfies the conditions used in the numeric analysis.

The aperture 12 constituting the individual ink passage 32 corresponds to a coil 212*a* and a resistor 212*b* in the circuit of FIG. 9A. The piezoelectric actuator 50 and the pressure chamber 10 correspond to a capacitor 250 and a capacitor 210 in the circuit of FIG. 9A, respectively. The descender 33 and the ejection port 8 correspond to a fluid analysis unit 233 in the circuit of FIG. 9A. The fluid analysis unit 233 is not considered a mere capacitor, resistor, or the like, in the circuit. The fluid analysis unit 233 is numerically analyzed separately by fluid analysis as will be described later.

In acoustic analysis in the numerical analysis, the volume Vd of the descender 33 as described in the above embodiment was used as a parameter. The compliance of the piezoelectric actuator 50, which is an acoustic capacitance corresponding to the capacitance of the capacitor 250 in the equivalent circuit, and the generation pressure constant of the piezoelectric actuator 50, were obtained in advance by a finite element technique from data of the piezoelectric actuator 50 and so on. The piezoelectric constant was obtained by using a resonance method in which the impedance of a piezoelectric element is measured. In the above embodiment, the compliance of the piezoelectric actuator 50 is 26.048 [$1e^{-2}1$ $m^5/N$]; the generation pressure constant is 17.933 [kPa/V]; the piezoelectric constant d31 is 177 [pm/V]; and the deformation is 84 [nm] when the driving voltage is 20 V.

As described above, the fluid analysis unit 233 corresponds to the descender 33. FIG. 9B shows a whole structure of the descender 33, as shown in FIG. 4, in a form used in fluid analysis of the fluid analysis unit 233. FIG. 9C shows a structure of a portion of the descender 33 formed through the nozzle plate 30. The left end of FIG. 9B coincides with one end of the pressure chamber 10.

The fluid analysis was performed for six inkjet heads a, b, c, d, e, and f, different in the volume Vd of the descender 33, that is, different in the length L1 though the inner diameter D1 is the same. In these six inkjet heads a to f, the volumes of the descenders 33 are 0.12 times, 0.15 times, 0.20 times, 0.38 times, 0.40 times, and 0.43 times the volume Vc of the individual ink passage 32, respectively. The values of the inner diameters D1 and D2 and the values of the lengths L2 and L3 of the descender 33 are as shown in the following Table 1. The inner diameter D1 corresponds to the diameter of the portion of the descender 33 formed through the plates other than the nozzle plate 30. The inner diameter D2 corresponds to the diameter of the ejection port 8. In this numeric analysis, as shown in FIG. 9B, the portion of the descender 33 formed through the plates other than the nozzle plate 30 has the same diameter at any position. The portion of the descender 33 formed through the nozzle plate 30 has its length L2. As shown in FIG. 9C, this portion has a structure tapered toward the ejection port 8. Part of this portion of a length L3 near the ejection port 8 has the same inner diameter D2 at any position. The inner surface of the tapered structure part of this portion and the inner diameter of the part of this portion near the ejection port 8 form an angle of 8 degrees in the sectional view of FIG. 9C as shown in Table 1. The thickness of an oscillation plate was 50 micrometers.

TABLE 1

| D1 | D2 | L2 | L3 | θ |
|---|---|---|---|---|
| 184 micrometers | 20 micrometers | 50 micrometers | 10 micrometers | 8 degrees |

Other common numeric conditions of the inkjet heads a to f are as shown in the following Table 2.

TABLE 2

| Pressure chamber | | Aperture (throttle) | | |
|---|---|---|---|---|
| Area [$mm^2$] | Depth [micrometer] | Length [micrometer] | Width [micrometer] | Depth [micrometer] |
| 0.273 | 100 | 302 | 39.5 | 20 |

The fluid analysis was performed in the fluid analysis unit 233 using the above-described structure of the descender 33 by the quasi compressibility method as a fluid analysis method formulated by quasi compressibility. The quasi compressibility method is a method for obtaining velocity and pressure by making the Navier-Stokes equation simultaneous with an equation of continuity in which a term representing a quasi time change in density has been added.

The compliance of the pressure chamber 10, which is an acoustic capacitance C corresponding to the capacitance of the capacitor 210 in the equivalent circuit, was obtained by a relational expression C=W/Ev, where W represents the volume of the pressure chamber 10 and Ev represents the volume elasticity of ink.

The inertance of the aperture 12, corresponding to the inductance of the coil 212*a* in the equivalent circuit, was obtained by a relational expression $m=\rho\times 1/A$, where ρ represents the ink density; A represents the area of a section of the aperture 12 perpendicular to a longitudinal axis of the aperture, that is, horizontal in FIG. 4; and l represents the length of the aperture 12 horizontal in FIG. 4.

The passage resistance of the aperture 12, corresponding to the resistance R of the resistor 212*b*, was obtained as follows. In the above-described embodiment, each aperture 12 has a rectangular shape having its sides of a length of 2a and sides of a length of 2b, in a sectional view perpendicular to a longitudinal axis of the aperture, that is, horizontal in FIG. 4. In this case, the quantity of ink flowing in the aperture 12 is obtained by the following Expression 1. The relation between the pressure Δp to be applied in the aperture 12, corresponding to the amplitude of the pressure wave, and the quantity Q of ink flowing in the aperture 12, is expressed by $Q=\Delta p/R$. The resistance R is calculated from the relation and Expression 1. In Expression 1, l represents the length of the aperture 12, as described above.

$$Q = \frac{4ab^3\Delta p}{3\,\mu l}\left[1 - \frac{192b}{\pi^5 a}\sum_{n=1,3,\ldots}^{\infty}\frac{1}{n^5}\tanh\left(\frac{n\pi a}{2b}\right)\right] \quad \text{[Expression 1]}$$

In the fluid analysis in the fluid analysis unit 233, the volume velocity of ink passing through the fluid analysis unit 233 is obtained. As a condition corresponding to the voltage to be applied between the individual electrode 35 and the common electrode 34 in the piezoelectric actuator 50, it was supposed that a pressure P corresponding to the voltage was applied by a pressure source 299 in the circuit. Under the above-described conditions, on the basis of the pressure P, the acoustic capacitance, the inertance, and the resistance; and analysis results in the fluid analysis unit obtained by separate numeric analysis, the volume velocity of ink flowing through the circuit, that is, the ink ejection speed, was obtained for each of the inkjet heads a to f by numeric analysis with changing the value of (the width Tl of the ejection pulse)/(the ink proper oscillation period Tc in the individual ink passage). The following Table 3 shows results of the numeric analysis.

In the numeric analysis, the driving voltage was 20 V. The driving voltage corresponds to the difference in the level of the voltage pulse supplied to the individual electrode 35 of the piezoelectric actuator 50. That is, the driving voltage indicates the maximum potential difference U0 between the individual electrode 35 and the common electrode 34, as shown in FIG. 7.

TABLE 3

| | Vd/Vc | | | | | |
|---|---|---|---|---|---|---|
| $T_l/T_c$ | 0.12 | 0.15 | 0.20 | 0.38 | 0.40 | 0.43 |
| 0.34 | 4.78 | 4.77 | 4.42 | 4.02 | 3.93 | 3.61 |
| 0.36 | 4.85 | 4.83 | 4.48 | 4.08 | 3.98 | 3.66 |
| 0.37 | 5.20 | 5.42 | 4.93 | 4.62 | 4.45 | 4.27 |
| 0.38 | 5.94 | 6.43 | 5.69 | 5.45 | 5.39 | 5.20 |
| 0.40 | 6.35 | 6.67 | 6.10 | 6.20 | 5.94 | 5.74 |
| 0.41 | 6.79 | 6.93 | 6.43 | 6.40 | 6.21 | 6.01 |
| 0.42 | 7.08 | 7.15 | 6.80 | 6.53 | 6.34 | 5.90 |
| 0.44 | 7.28 | 7.22 | 7.07 | 6.87 | 6.47 | 8.65 |
| 0.45 | 7.85 | 7.76 | 7.69 | 7.60 | 7.04 | 9.42 |
| 0.47 | 8.55 | 8.89 | 8.94 | 8.69 | 8.54 | 9.37 |
| 0.48 | 9.03 | 9.31 | 9.56 | 9.37 | 9.07 | 8.94 |
| 0.49 | 9.16 | 9.35 | 9.37 | 8.87 | 8.58 | 8.03 |
| 0.51 | 9.28 | 9.30 | 9.06 | 8.64 | 7.98 | 7.46 |
| 0.52 | 9.11 | 9.27 | 9.13 | 8.65 | 7.96 | 7.44 |
| 0.53 | 8.59 | 8.74 | 8.52 | 8.12 | 7.56 | 7.06 |
| 0.55 | 7.88 | 8.10 | 7.86 | 7.46 | 6.49 | 5.90 |
| 0.56 | 7.14 | 7.15 | 6.64 | 6.24 | 5.44 | 4.98 |
| 0.58 | 6.39 | 6.28 | 5.87 | 5.24 | 4.68 | 4.21 |
| 0.59 | 5.84 | 5.57 | 5.32 | 4.67 | 4.02 | 3.70 |
| 0.60 | 5.69 | 5.45 | 5.10 | 4.32 | 3.87 | 3.56 |

Figure 10:
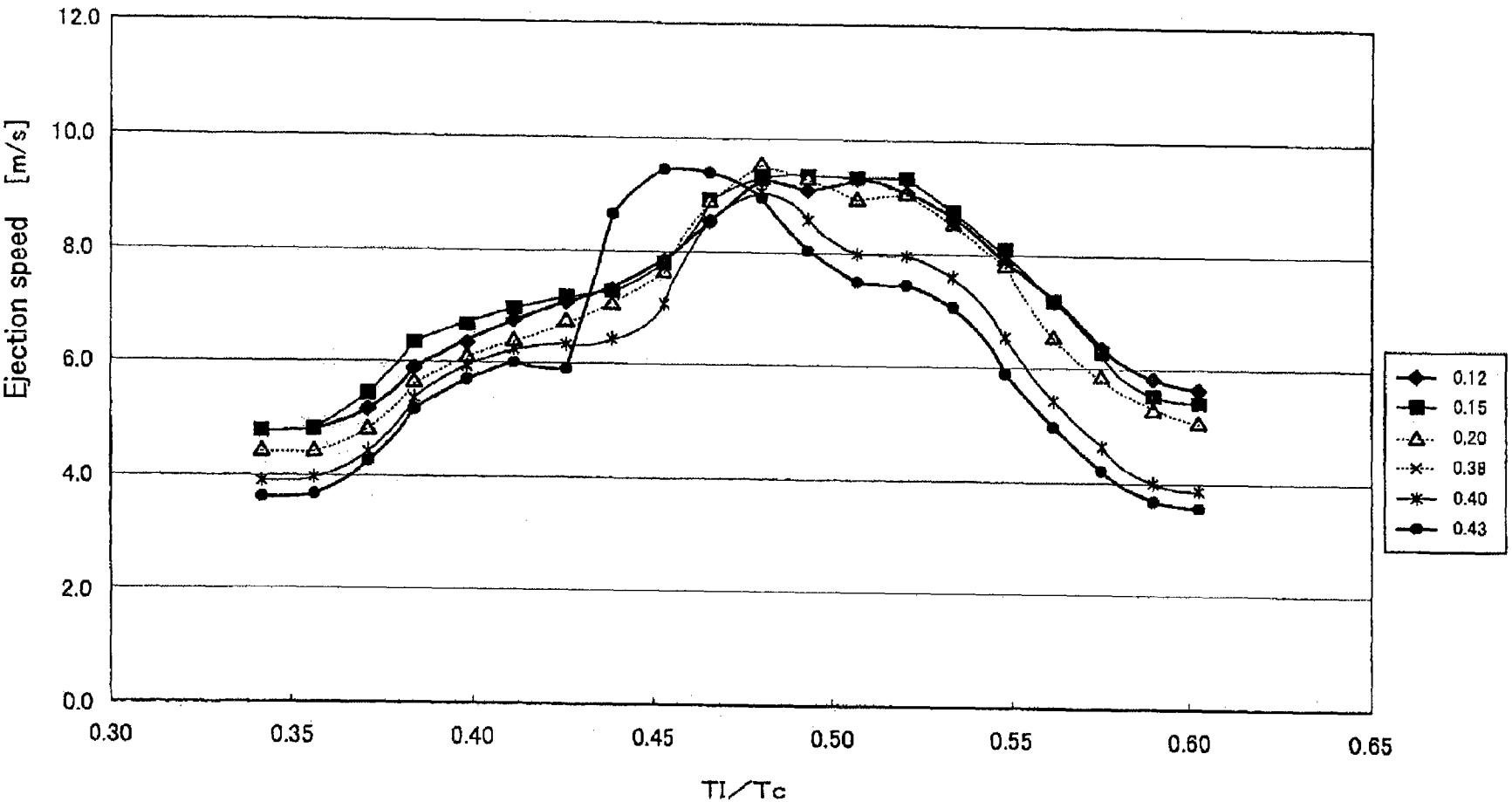
FIG. 10 is a graph showing results of numeric analysis performed by using the model of FIGS. 9A to 9C.

FIG. 10 is a graph showing the results of the above Table 3. In FIG. 10, the axis of abscissas represents Tl/Tc, and the axis of ordinate represents the ink droplet ejection speed. When Vd/Vc is 0.43, the ink ejection speed sharply changes near a maximal value on the curved line that represents a change in ink ejection speed relative to a change in Tl/Tc. On the other hand, when Vd/Vc is not less than 0.12 and not more than 0.40, the ink ejection speed does not sharply-change near any maximal value on any curved line that represents a change in ink ejection speed relative to a change in Tl/Tc.

Further, changes in speed and volume ratios between the first ink droplet and the second ink droplet, which is formed from a lump of liquid elongated after the first ink droplet, ejected from a nozzle in accordance with one ejection pulse, relative to a change in Vd/Vc, were obtained by numeric analysis in the fluid analysis unit 233 of the equivalent circuit shown in FIG. 9A, when the value of Tl/Tc was fixed to Tl/Tc=0.45 and when the value of Tl/Tc was fixed to Tl/Tc=0.48. The following Tables 4 and 5 show results of the numeric analysis.

TABLE 4

| | Vd/Vc | | | | | |
|---|---|---|---|---|---|---|
| Tl/Tc = 0.45 | a: 0.12 | b: 0.15 | c: 0.20 | d: 0.38 | e: 0.40 | f: 0.43 |
| Speed ratio | 1.01 | 1.02 | 1.03 | 1.07 | 1.09 | 1.35 |
| Volume ratio | 1.13 | 1.10 | 1.07 | 0.97 | 0.92 | 0.32 |

TABLE 5

| | Vd/Vc | | | | | |
|---|---|---|---|---|---|---|
| Tl/Tc = 0.48 | a: 0.12 | b: 0.15 | c: 0.20 | d: 0.38 | e: 0.40 | f: 0.43 |
| Speed ratio | 1.02 | 1.03 | 1.05 | 1.08 | 1.10 | 1.24 |
| Volume ratio | 1.17 | 1.12 | 1.08 | 0.96 | 0.90 | 0.47 |

Figure 11:
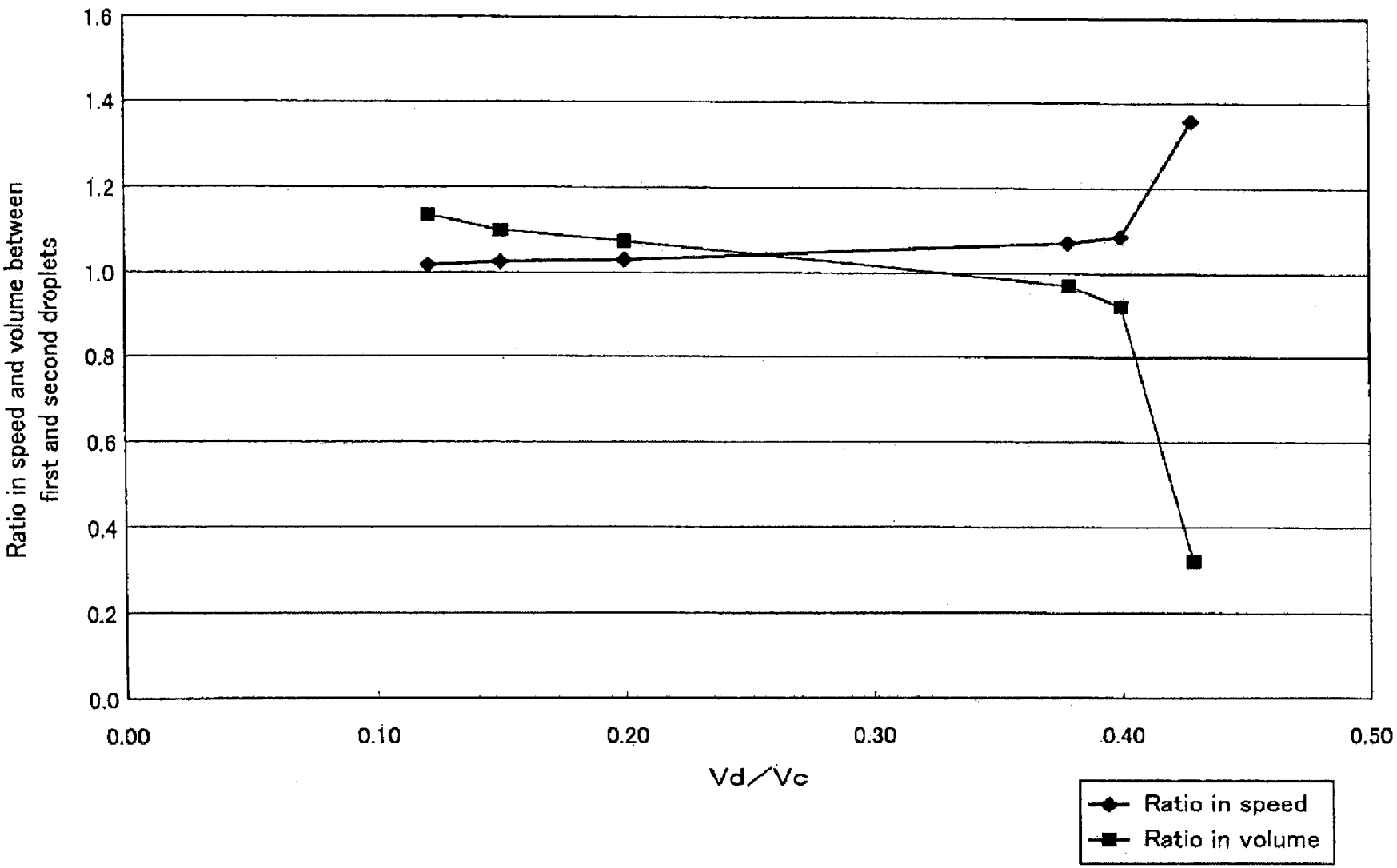
FIG. 11 is another graph showing results of the numeric analysis performed by using the model of FIGS. 9A to 9C.
Figure 12:
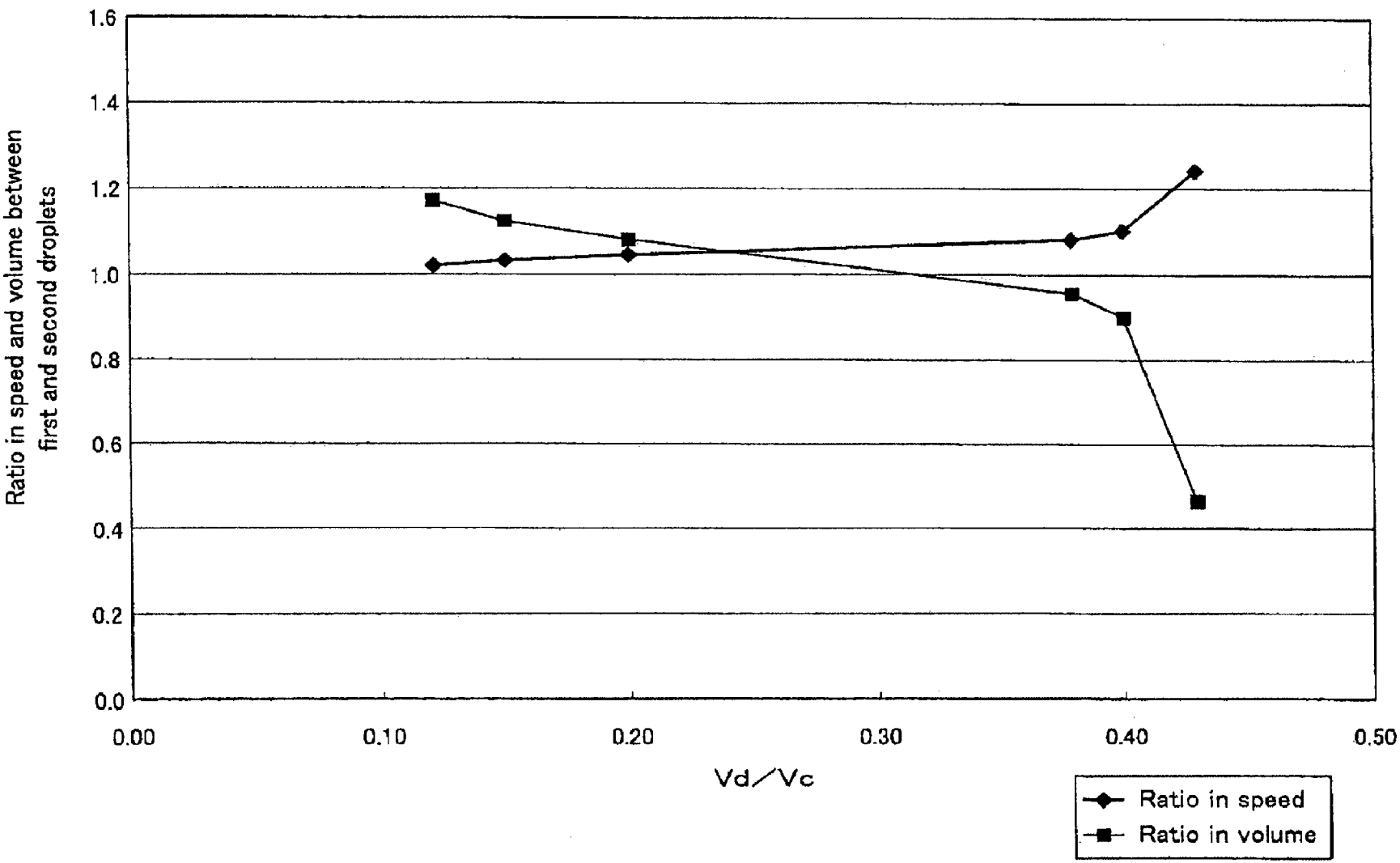
FIG. 12 is another graph showing results of the numeric analysis performed by using the model of FIGS. 9A to 9C.

FIGS. 11 and 12 are graphs showing the results of the above Tables 4 and 5. In FIGS. 11 and 12, the axis of abscissas represents Vd/Vc, and the axis of ordinate represents the ratios of speed and volume between the first and second ink droplets ejected from a nozzle in accordance with one ejection pulse. In either of the cases wherein Tl/Tc is 0.45 and wherein Tl/Tc is 0.48, the first and second ink droplets in accordance with one ejection pulse remarkably differ from each other in speed and volume when Vd/Vc is 0.43. On the other hand, when Vd/Vc is not less than 0.12 and not more than 0.40, the first and second ink droplets in accordance with one ejection pulse are substantially equal to each other in speed and volume.

In addition, it is understood from FIGS. 11 and 12 that the volume ratio between the first and second ink droplets is farther from one when Vd/Vc=0.12, in comparison with the case wherein Vd/Vc is within the range from 0.15 to 0.40.

The results of the above-described analysis on the basis of the equivalent circuit shown in FIG. 9A lead to the following conclusion. When Vd/Vc is not less than 0.12 and not more than 0.40, the ink ejection speed does not sharply change near any maximal value on the curved line that represents a change in ink ejection speed relative to a change in Tl/Tc, and the first and second ink droplets in accordance with one ejection pulse are prevented from remarkably differing from each other in speed and volume. In addition, when Vd/Vc is not less than 0.15 and not more than 0.40, better results are obtained.

In the above-described embodiment, each descender can be formed so as to be sufficiently long because the distance of the pressure chamber from the ejection face is larger than the distance of the common ink chamber from the ejection face. This brings about an advantage of increasing the degree of freedom in design of the inkjet head for satisfying the condition that Vd/Vc is not less than 0.12 and not more than 0.40.

Next, with fixing the value of Tl/Tc to 0.48, the driving voltage that brings about an ejection speed of 9 m/s of the first ink droplet in accordance with one ejection pulse, was obtained by numeric analysis using the equivalent circuit shown in FIG. 9A, in each case of Vd/Vc=0.12, 0.2, 0.3, and 0.4 and in each case of square-root (Sd/π)/Ld=0.05, 0.08, 0.10, 0.20, 0.30, 0.35, and 0.40, obtained by changing the diameter of the descender 33 at a fixed length of the descender 33. The following Table 6 shows results of the analysis.

TABLE 6

| Tl/Tc = 0.48 | | Vd/Vc 0.12 | 0.2 | 0.3 | 0.4 |
|---|---|---|---|---|---|
| Square-root (Sd/π)/Ld | 0.05 | 22.0 | 23.9 | 26.0 | 28.2 |
| | 0.08 | 20.5 | 21.5 | 23.0 | 23.9 |
| | 0.10 | 20.0 | 20.9 | 22.1 | 22.8 |
| | 0.20 | 19.1 | 19.4 | 20.4 | 21.0 |
| | 0.30 | 18.7 | 19.1 | 19.8 | 20.2 |
| | 0.35 | 18.6 | 19.0 | 19.8 | 20.2 |
| | 0.40 | 18.6 | 19.0 | 19.7 | 20.1 |

Figure 13:
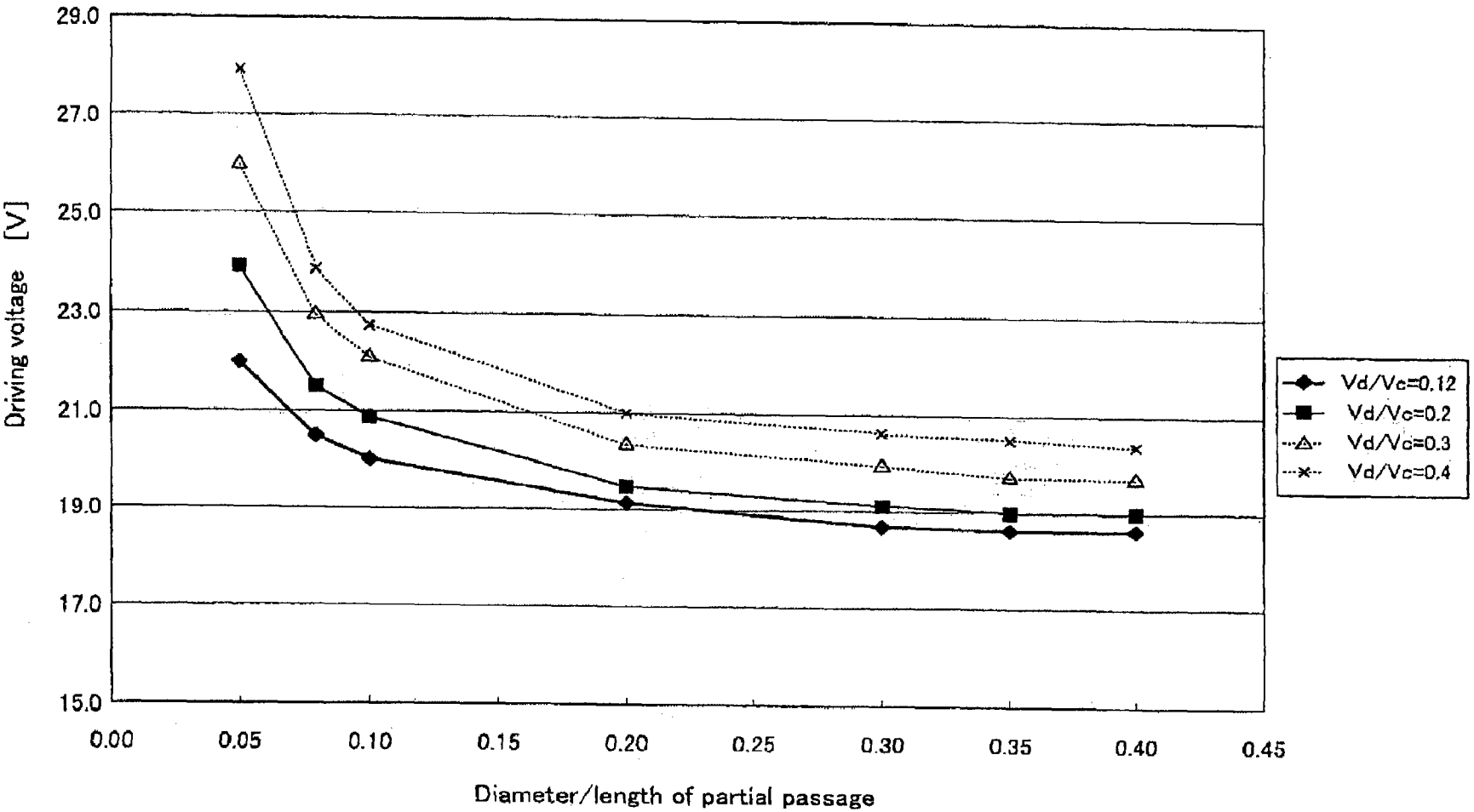
FIG. 13 is another graph showing results of the numeric analysis performed by using the model of FIGS. 9A to 9C.

FIG. 13 is a graph showing the results of the above Table 6. In FIG. 13, the axis of abscissas represents square-root (Sd/π)/Ld, and the axis of ordinate represents the driving voltage. In either case of Vd/Vc=0.12, 0.2, 0.3, and 0.4, when the value of square-root (Sd/π)/Ld is less than 0.10, the driving voltage is remarkably high because the acoustic resistance of the descender 33 is low. On the other hand, even when the value of square-root (Sd/π)/Ld exceeds 0.30, the driving voltage scarcely decreases.

The following Table 7 is obtained by converting the above Table 6 by focusing attention on the decrease rate of the driving voltage. From Table 7, it is understood that the decrease rate of the driving voltage exceeds 20% when the value of square-root (Sd/π)/Ld is less than 0.10. The decrease rate of the driving voltage beyond 20% is undesirable because it brings about an increase in variation in ink ejection speed from nozzle to nozzle caused by variation in descender diameter. Therefore, it is preferable that the value of square-root (Sd/π)/Ld is not less than 0.10.

TABLE 7

| Tl/Tc = 0.48 | | Vd/Vc 0.12 | 0.2 | 0.3 | 0.4 |
|---|---|---|---|---|---|
| Square-root (Sd/π)/Ld | 0.05-0.08 | −50.0 | −80.0 | −100.0 | −143.3 |
| | 0.08-0.10 | −25.0 | −30.0 | −45.0 | −55.0 |
| | 0.10-0.20 | −9.0 | −15.0 | −17.0 | −18.0 |
| | 0.20-0.30 | −4.0 | −3.0 | −4.0 | −6.0 |
| | 0.30-0.35 | −2.0 | −2.0 | −4.0 | −4.0 |
| | 0.35-0.40 | −0.0 | −0.0 | −2.0 | −2.0 |

Next, with fixing the value of Tl/Tc to 0.48, the time necessary for the amplitude of oscillation generated on the meniscus of ink formed near an ejection port 8 when a stepwise pulse as shown in FIG. 7 is applied to the corresponding piezoelectric actuator 50, which oscillation has its period shorter than the ink proper oscillation period Tc in the individual ink passage, that is, which oscillation is short-period pressure variation, decreasing to 90% the initial amplitude of the oscillation, was obtained by numeric analysis using the equivalent circuit shown in FIG. 9A, in each case of Vd/Vc=0.12, 0.2, 0.3, and 0.4 and in each case of square-root (Sd/π)/Ld=0.05, 0.08, 0.10, 0.20, 0.30, 0.35, and 0.40, obtained by changing the diameter of the descender 33 at a fixed length of the descender 33. The following Table 8 shows results of the analysis.

TABLE 8

| Tl/Tc = 0.48 | | Vd/Vc 0.12 | 0.2 | 0.3 | 0.4 |
|---|---|---|---|---|---|
| Square-root (Sd/π)/Ld | 0.05 | 35.7 | 30.5 | 25.3 | 15.4 |
| | 0.08 | 36.0 | 30.9 | 25.9 | 16.1 |
| | 0.10 | 36.0 | 31.3 | 26.7 | 17.0 |
| | 0.20 | 37.0 | 32.0 | 27.9 | 19.2 |
| | 0.30 | 42.0 | 34.3 | 30.5 | 21.7 |
| | 0.35 | 50.0 | 39.2 | 33.2 | 25.6 |
| | 0.40 | 63.7 | 51.1 | 44.0 | 39.0 |

Figure 14:
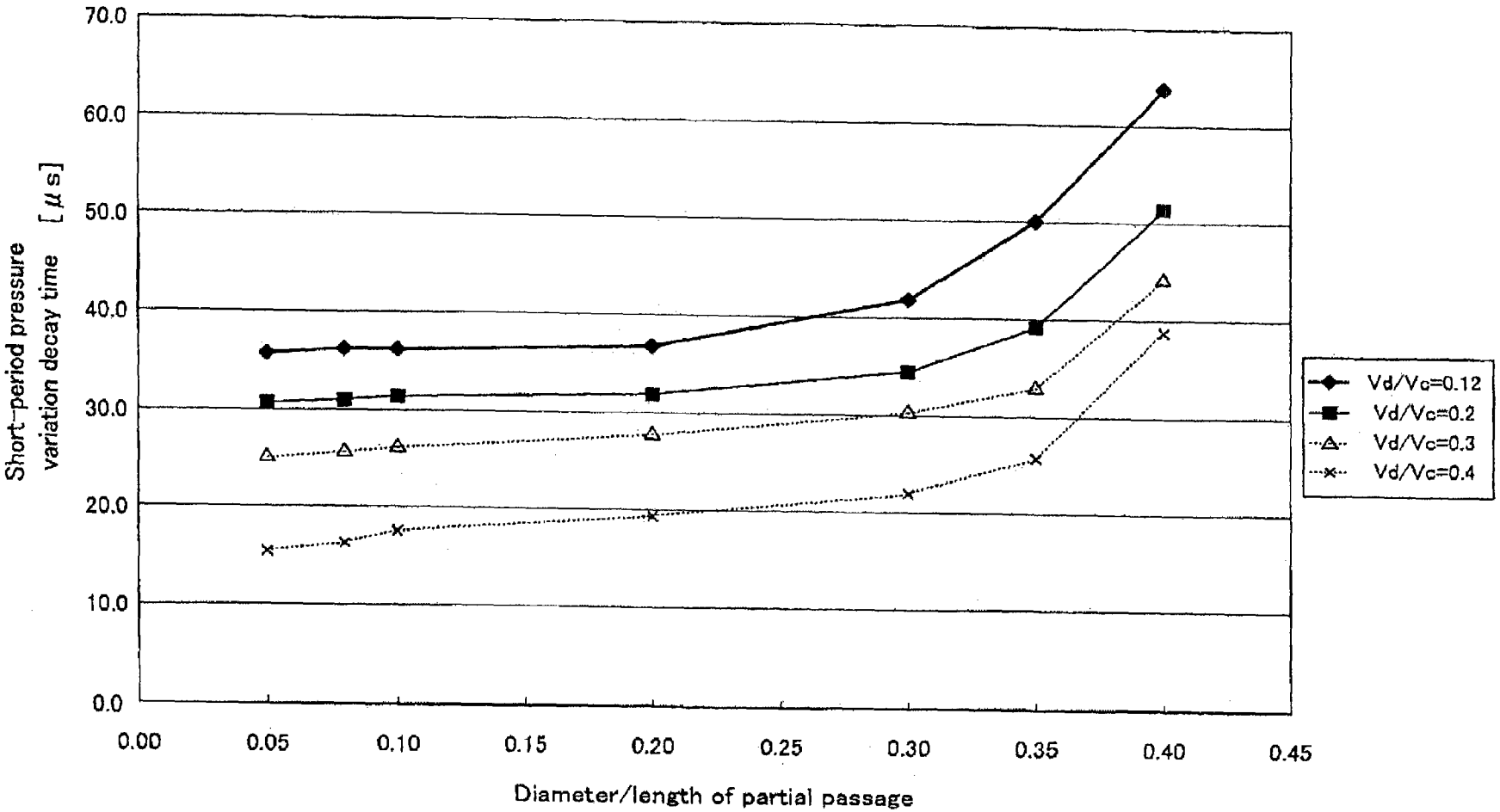
FIG. 14 is another graph showing results of the numeric analysis performed by using the model of FIGS. 9A to 9C.

FIG. 14 is a graph showing the results of the above Table 8. In FIG. 14, the axis of abscissas represents the value of square-root (Sd/π)/Ld, and the axis of ordinate represents the decay time of the short-period pressure variation from its initial amplitude to 90%. In either case of Vd/Vc=0.12, 0.2, 0.3, and 0.4, when the value of square-root (Sd/π)/Ld exceeds 0.30, the decay time of the short-period pressure variation is remarkably long. On the other hand, even when the value of square-root (Sd/π)/Ld is not more than 0.20, the decay time scarcely decreases.

The following Table 9 is obtained by converting the above Table 8 by focusing attention on the decrease rate of the decay time. From Tables 8 and 9, it is understood that the short-period pressure variation influences ink ejection for a long time when the value of square-root (Sd/π)/Ld exceeds 0.30. In particular, when ink droplets are successively ejected from a nozzle, an ink droplet ejected later is adversely affected. This is undesirable. Contrastingly, when the value of square-root (Sd/π)/Ld is not more than 0.30, the pressure variation having a period shorter than Tc in the individual ink passage is easy to be attenuated. Thus, even when ink droplets are successively ejected from a nozzle, any ink droplet ejected later is hard to be adversely affected. Therefore, it is preferable that the value of square-root (Sd/π)/Ld is not more than 0.30.

TABLE 9

| Tl/Tc = 0.48 | | Vd/Vc 0.12 | 0.2 | 0.3 | 0.4 |
|---|---|---|---|---|---|
| Square-root (Sd/π)/Ld | 0.05-0.08 | 10.0 | 13.3 | 20.0 | 23.3 |
| | 0.08-0.10 | 0.0 | 20.0 | 40.0 | 45.0 |
| | 0.10-0.20 | 10.0 | 7.0 | 12.0 | 22.0 |
| | 0.20-0.30 | 50.0 | 23.0 | 26.0 | 25.0 |
| | 0.30-0.35 | 160.0 | 98.0 | 54.0 | 78.0 |
| | 0.35-0.40 | 274.0 | 238.0 | 216.0 | 268.0 |

In the above-described fluid analysis, the descender 33 was supposed to be a straight pipe. In another case, however, the descender 33 may be supposed to be a combination of pipes different in inner diameter in accordance with the actual shape of the descender 33.

In the above-described inkjet head, the construction of the actuator, the shape of the individual ink passage, and so on, can arbitrarily be changed.

In addition, as far as the condition that Vd/Vc is not less than 0.15 and not more than 0.40 is satisfied, the volume Vd of the descender 33 may be any times the volume Vc of the individual ink passage 32. In the above-described embodiment, the condition that the value of square-root (Sd/π)/Ld is not less than 0.1 and not more than 0.3 is satisfied. In a modification, however, the condition may not be satisfied. Further, in a modification, the distance of each pressure chamber 10 from the ejection face may be smaller than the distance of the corresponding sub manifold channel 5*a* from the ejection face.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An inkjet head comprising:

a passage unit comprising a common ink chamber and an individual ink passage leading from an outlet of the common ink chamber through a pressure chamber to an ejection port; and an actuator that can selectively take a first state in which the volume of the pressure chamber is V1 and a second state in which the volume of the pressure chamber is V2 larger than V1, the actuator changing from the first state into the second state and then returning to the first state to eject ink from the ejection port, the individual ink passage being formed such that the volume Vd of a partial passage in the individual ink passage corresponding to a region from an outlet of the pressure chamber to the ejection port, and the volume Vc of the individual ink passage, satisfy a condition that Vd/Vc is not less than 0.12 and not more than 0.40.

2. The inkjet head according to claim 1, wherein the individual ink passage is formed so as to satisfy a condition that Vd/Vc is not less than 0.15 and not more than 0.40.

3. The inkjet head according to claim 1, wherein the length Ld of the partial passage and the mean sectional area Sd of the partial passage satisfy a condition that the value obtained by dividing the square root of $(Sd/\pi)$ by Ld is not less than 0.1 and not more than 0.3.

4. The inkjet head according to claim 1, wherein the passage unit comprises an ejection face on which the ejection port is formed, and the distance of the pressure chamber from the ejection face is larger than the distance of the common ink chamber from the ejection face.

* * * * *